US011690484B2

(12) United States Patent
Warren et al.

(10) Patent No.: US 11,690,484 B2
(45) Date of Patent: Jul. 4, 2023

(54) PORTABLE WASHBASIN SYSTEM

(71) Applicant: Alaska Native Tribal Health Cosortium, Anchorage, AK (US)

(72) Inventors: John Warren, Anchorage, AK (US); Jon Dufendach, Delta Junction, AK (US)

(73) Assignee: Alaska Native Tribal Health Consortium, Anchorage, AK (US)

( * ) Notice: Subject to any disclaimer, the term of this patent is extended or adjusted under 35 U.S.C. 154(b) by 0 days.

(21) Appl. No.: 17/451,740

(22) Filed: Oct. 21, 2021

(65) Prior Publication Data

US 2022/0031124 A1 Feb. 3, 2022

Related U.S. Application Data

(63) Continuation-in-part of application No. 16/508,148, filed on Jul. 10, 2019, now Pat. No. 11,172,790.

(60) Provisional application No. 62/696,763, filed on Jul. 11, 2018.

(51) Int. Cl.

| | |
|---|---|
| ***A47K 1/00*** | (2006.01) |
| ***A47K 1/02*** | (2006.01) |
| ***A47K 4/00*** | (2006.01) |

(52) U.S. Cl.

CPC . *A47K 1/02* (2013.01); *A47K 4/00* (2013.01)

(58) Field of Classification Search

CPC ..... C02F 1/001; A47K 2210/00; A47K 4/00; A47K 1/02; A47K 1/00; E03D 5/016; E03D 5/00; E03D 5/003; E03D 5/006; E03D 5/01; E03D 5/014

USPC ..... 4/619, 625, 626, 630, 638, 664

See application file for complete search history.

(56) References Cited

U.S. PATENT DOCUMENTS

| | | | | |
|---|---|---|---|---|
| 187,991 | A | 3/1877 | Thompson | |
| 345,053 | A | 7/1886 | Heap | |
| 3,045,252 | A * | 7/1962 | Sorrells | A47L 13/50 4/626 |
| 3,579,655 | A | 5/1971 | Sundberg | |
| 3,601,821 | A | 8/1971 | Corsiglia | |

(Continued)

FOREIGN PATENT DOCUMENTS

| | | |
|---|---|---|
| CN | 2778171 Y | 5/2006 |
| CN | 201510224 U | 6/2010 |

(Continued)

OTHER PUBLICATIONS

International Search Report and Written Opinion for Application No. PCT/US2020/035395, dated Sep. 3, 2020, 11 pages.

(Continued)

*Primary Examiner* — Charles P. Cheyney

(74) *Attorney, Agent, or Firm* — Stoel Rives LLP

(57) ABSTRACT

A portable washbasin system for providing clean water for washing hands and maintaining appropriate hygiene, the system including a housing structure with an upper compartment and a lower compartment spaced apart from one another, and a sink supported on the housing structure between the upper and lower compartments. A water storage tank is housed in the upper compartment, where the sink receives water from the water storage tank and dispenses the water for use. The system further includes a water receptacle housed in the lower compartment for collecting wastewater from the sink for subsequent disposal.

20 Claims, 7 Drawing Sheets

(56) References Cited

U.S. PATENT DOCUMENTS

| | | | | |
|---|---|---|---|---|
| 3,629,874 | A | 12/1971 | Beller | |
| 4,998,302 | A * | 3/1991 | Silva | A45D 19/04 4/516 |
| 5,522,411 | A * | 6/1996 | Johnson | A47K 10/48 134/107 |
| 5,860,437 | A * | 1/1999 | Fernie | E03C 1/057 134/104.1 |
| 6,173,459 | B1 * | 1/2001 | Ball | E03C 1/232 4/683 |
| 6,253,394 | B1 * | 7/2001 | Goyette | E03C 1/01 4/626 |
| 6,615,414 | B2 | 9/2003 | Miller et al. | |
| 7,135,116 | B2 | 11/2006 | Haggerty | |
| 7,846,143 | B1 | 12/2010 | Abbato | |
| 8,082,611 | B1 * | 12/2011 | Marshall | A47K 1/02 239/146 |
| 8,162,145 | B1 * | 4/2012 | Merritt | E04H 9/14 206/541 |
| 8,245,330 | B2 * | 8/2012 | Atkinson | E03B 11/02 4/625 |
| 8,528,126 | B2 * | 9/2013 | Al-Mahnna | A47K 1/02 4/626 |
| 8,652,413 | B2 * | 2/2014 | Vitali | A61B 90/80 422/292 |
| 8,844,069 | B1 * | 9/2014 | Harvey | A47K 1/02 4/625 |
| 9,303,420 | B2 | 4/2016 | Van Der Linde | |
| 9,364,124 | B2 | 6/2016 | Morris | |
| 9,493,937 | B2 | 11/2016 | Derenoncourt | |
| 9,737,180 | B2 | 8/2017 | Banner et al. | |
| 10,123,668 | B2 * | 11/2018 | Derenoncourt | E04H 1/1216 |
| 10,271,691 | B1 * | 4/2019 | Boyle | A47K 1/02 |
| 11,503,963 | B2 * | 11/2022 | Lizotte | A47K 1/02 |
| 2003/0019031 | A1 * | 1/2003 | Mosis | E03C 1/18 4/625 |
| 2005/0199267 | A1 * | 9/2005 | Oakes | B08B 3/006 134/40 |
| 2010/0050330 | A1 | 3/2010 | Earlywine | |
| 2013/0167293 | A1 * | 7/2013 | Nakaya | B01D 53/26 4/321 |
| 2014/0172523 | A1 * | 6/2014 | Stob | A47K 5/1217 222/25 |
| 2015/0344323 | A1 * | 12/2015 | Mahdjoubi Namin | E03C 1/00 210/86 |
| 2017/0007082 | A1 | 1/2017 | Li | |
| 2021/0321829 | A1 * | 10/2021 | Shell | A47K 1/02 |

FOREIGN PATENT DOCUMENTS

| | | | |
|---|---|---|---|
| DE | 3515906 | A1 | 11/1985 |
| EP | 1020155 | A2 | 7/2000 |
| RU | 40424 | U1 | 9/2004 |
| RU | 2243916 | C2 | 1/2005 |
| RU | 110390 | U1 | 11/2011 |
| RU | 159122 | U1 | 1/2016 |
| WO | 2004008930 | A1 | 1/2004 |

OTHER PUBLICATIONS

International Search Report and Written Opinion for International Application No. PCT/US2019/041460, dated Oct. 17, 2019, 7 pages.

EARTH2WENDY, My Separett Privy Tour, YOUTUBE, available at: https://www.youtube.com/watch?v=I5PNvqqwPOk, Aug. 27, 2017, from timestamp 6:15-7:10 (select screenshots attached).

* cited by examiner

PORTABLE WASHBASIN SYSTEM

RELATED APPLICATION DATA

This application is a continuation-in-part of and claims the benefit under 35 U.S.C. § 120 of U.S. patent application Ser. No. 16/508,148, filed Jul. 10, 2019, which claims the benefit under 35 U.S.C. § 119(e) of U.S. Provisional Patent Application No. 62/696,763, filed Jul. 11, 2018, the disclosures of which are incorporated by reference herein in their entireties.

TECHNICAL FIELD

The field of the present disclosure relates generally to improved sanitation systems, and in particular, to a portable washbasin system designed for providing clean water for washing hands and maintaining appropriate hygiene in areas where running water is not readily available.

BACKGROUND

Many homes, especially those in developed nations, include at least one bathroom with a toilet for receiving and handling human waste and a sink with clean water for washing hands and maintaining appropriate hygiene as needed. Such bathrooms typically operate in connection with plumbing and sewage systems that provide running water to facilitate flushing and removal of the human waste and to allow users to wash their hands with clean water. While plumbing systems are widely employed in many homes, such plumbing systems may not be available in all homes for various reasons. For example, in extremely cold climates, plumbing and sewage systems may be difficult to install and use because of constant freezing issues. Further, in coastal regions, land erosion may impact such systems and require more portable solutions to accommodate people periodically moving further inland due to a continuously eroding coastline. In impoverished regions, homes may not be permanent structures and water may be scarce, thereby making it impractical to install such complex plumbing systems.

Portable lavatory systems are generally known and used in many different settings in modern society. For example, such systems are commonly used during outdoor social events, such as, sporting events and concerts, or during construction projects for the convenience of the construction workers. These portable lavatories are typically self-contained systems in a singular stall or structure with a holding tank located under the toilet or urinal for receiving and storing the waste. Typically, such systems do not have any flushing water and lack proper venting to handle odor from the waste that accumulates in the holding tank. In addition, such portable systems typically lack sinks or provide running water to accommodate handwashing. While such systems may be useful for temporary outdoor events, they are generally unsanitary and not suitable for integrating into a home environment.

Accordingly, the present inventors have determined that it would be desirable to develop a portable washbasin system with improved features for providing clean water to support handwashing and other hygienic activities. The present inventors have also determined a need for such a portable system designed to collect the wastewater from the sink for subsequent disposal to accommodate use in regions with no plumbing systems or seepage pits. In addition, the present inventors have recognized a need for such an improved system specifically designed for in-home use and expedient deployment. Additional aspects and advantages will be apparent from the following detailed description of example embodiments, which proceeds with reference to the accompanying drawings. It should be understood that the drawings depict only certain example embodiments and are not to be considered as limiting in nature.

DETAILED DESCRIPTION OF EXAMPLE EMBODIMENTS

Figure 1A:
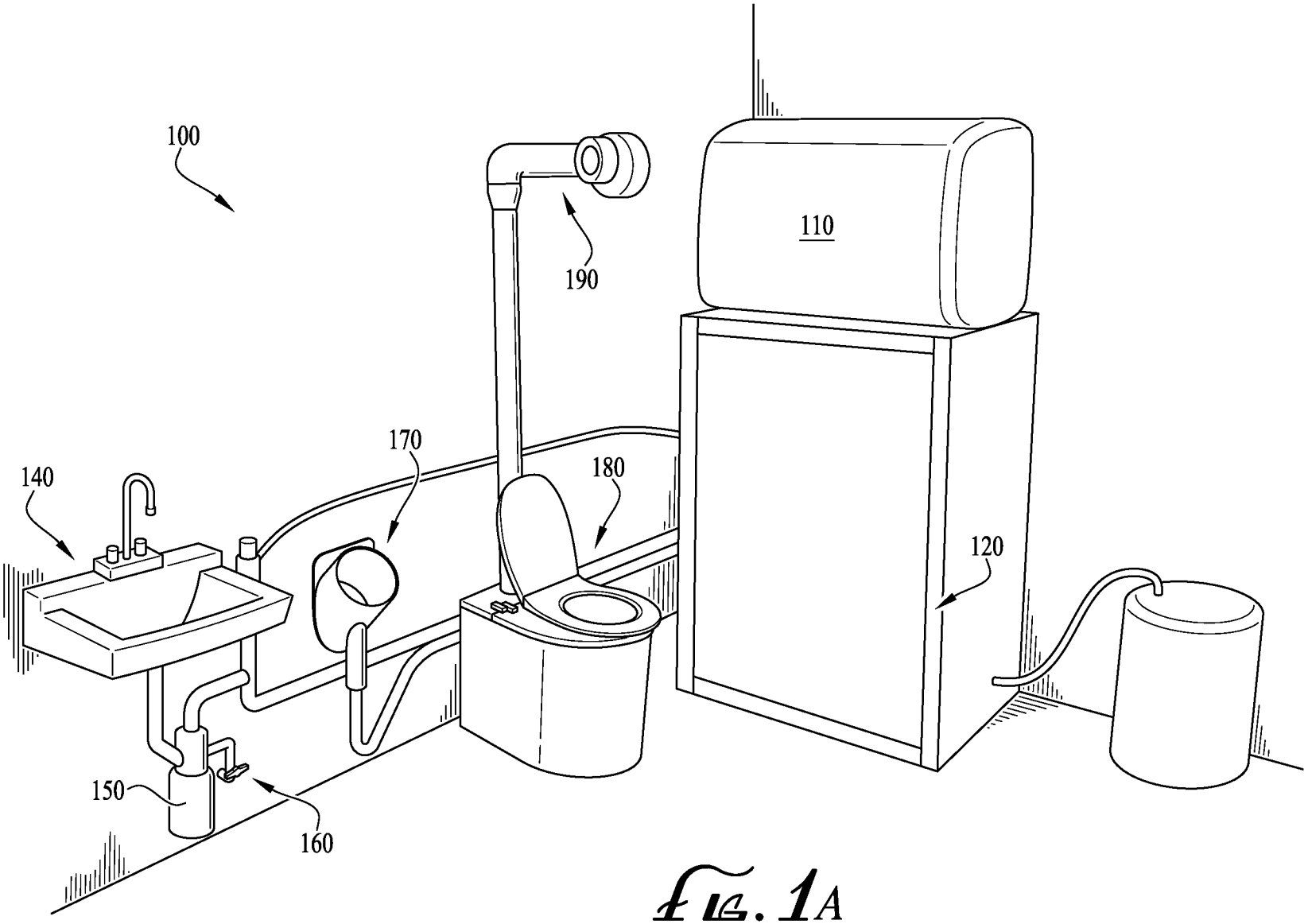
FIGS. 1A and 1B collectively illustrate components and an example layout of a portable sanitation system in accordance with one embodiment.

With reference to the drawings, this section describes particular embodiments of a sanitation system and a washbasin system and their detailed construction and operation. The embodiments described herein are set forth by way of illustration only and not limitation. Throughout the specification, reference to "one embodiment," "an embodiment," or "some embodiments" means that a particular described feature, structure, or characteristic may be included in at least one embodiment of the system or of the components being discussed. Thus, appearances of the phrases "in one embodiment," "in an embodiment," or "in some embodiments" in various places throughout this specification are not necessarily all referring to the same embodiment. Further, the described features, structures, characteristics, and methods of operation may be combined in any suitable manner in one or more embodiments. In view of the disclosure herein, those skilled in the art will recognize that the various embodiments can be practiced without one or more of the specific details or with other methods, components, materials, or the like. In other instances, well-known structures, materials, or methods of operation are not shown or not described in detail to avoid obscuring more pertinent aspects of the embodiments.

With general reference to the figures, the following disclosure relates generally to an improved system and method for providing basic sanitation needs (e.g., handwashing, clean water, human waste disposal, etc.) to homes and other structures where piped water systems are nonexistent or impractical, such as in impoverished regions or lands that may be vulnerable to flooding and erosion. In some communities, problems with land erosion are so severe that homeowners and agencies are reluctant to invest in piping and sewage infrastructure due to the short useful shelf-life of such systems under these conditions, thereby creating health risks and problems that could be remedied or avoided altogether with the disclosed sanitation system further described below.

As illustrated in FIGS. 1-8, the sanitation system 100 includes a variety of modular components that may be arranged to work together to provide clean water for homes, and to handle and dispose of human waste so as to minimize potential exposure to harmful pathogens. As described in further detail below, the sanitation system 100 is designed as a stand-alone model with components that may be easily assembled and disassembled to maximize portability of the system, thereby allowing the system to be dismantled and transported when homes are moved to new sites due to eroding coastlines, climate changes, or for other reasons. In addition, the sanitation system 100 provides privacy, safety, cleanliness, and a streamlined design that can be implemented at a relatively low cost. Accordingly, in addition to being a potential solution for areas with land erosion issues, the sanitation system 100 may be used in underdeveloped and impoverished regions, and/or may be used in other locations where access to basic sanitation facilities may be limited, such as camp grounds, deserts, and beaches.

In some embodiments, various components of the sanitation system 100 may be incorporated into a portable washbasin system 400 (see FIGS. 7-8) that can be installed as a single, integrated unit to streamline the design and building process. In other embodiments, the portable washbasin system 400 may instead be used to provide a stand-alone solution where only a washbasin is needed without necessity of other components of the sanitation system 100. Additional details of these and other embodiments of the sanitation system 100 and the portable washbasin system 400 are further discussed below with particular reference to the accompanying figures.

FIG. 1A illustrates an example layout of a portable sanitation system 100 housed within an enclosure or building in accordance with one embodiment. With reference to FIG. 1A, the sanitation system 100 includes a water storage tank 110 for storing water that will be used with the system 100. Preferably, the water storage tank 110 is elevated above other water-consuming fixtures to provide water via a gravity flow to the fixtures without the need for a distribution pump. In other embodiments, the water storage tank 110 may incorporate a pump connected to an electric source for pumping water as needed. The water in the storage tank 110 may be disinfected and/or purified via any suitable method to ensure that the water is safe for use.

The system 100 further includes a water treatment system 120 that may be in communication with the storage tank 110 (or connected to a separate water tank) to provide filtration that complies with federal and state drinking water requirements, thereby providing potable water that is safe for human consumption. The water treatment system 120 may include any of various suitable filtration devices operable to filter water, such as efficient cartridge filters and other similar devices. Preferably, the water treatment system 120 is designed such that it is easily movable so that it can be transported outdoors to provide filtered drinking water as needed. The water treatment system 120 may include a hand pump (not shown) that can be activated and used to allow the system to treat water without requiring electrical power. In other embodiments, the water treatment system 120 may instead include an electrical pump.

Figure 1B:
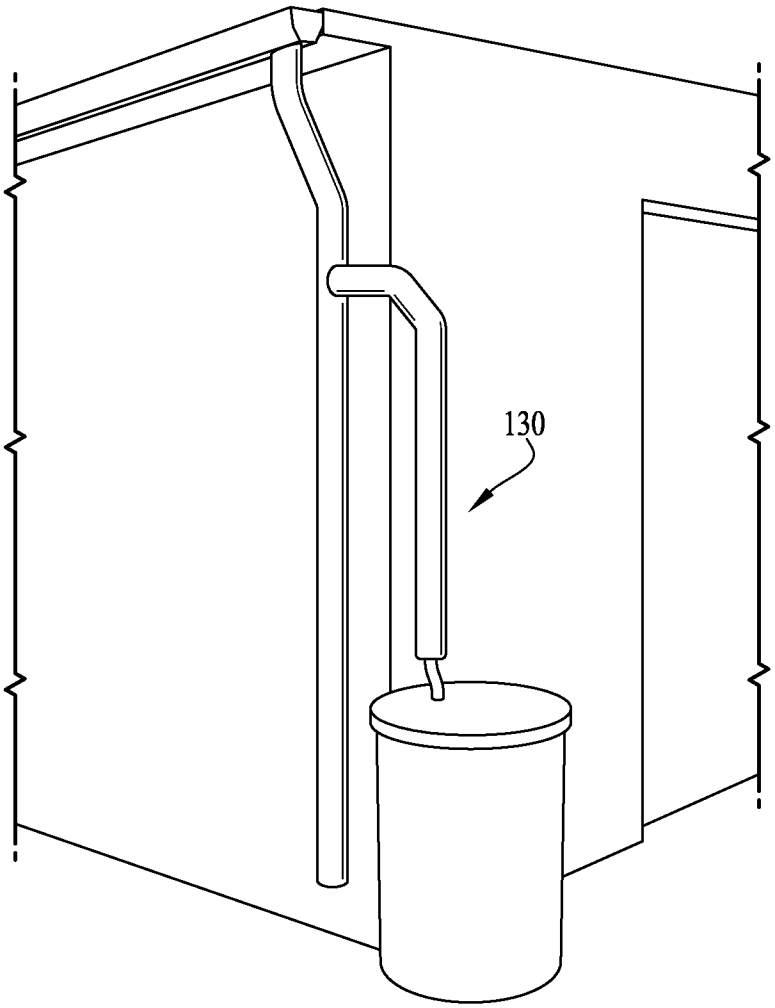

Water to the storage tank 110 (and/or to the tank with drinking water) may be provided in whole or in part by an exterior water catchment system 130. Generally speaking, water catchment is the process of collecting and storing rainwater, where the water may be reused for domestic tasks, or with sufficient filtration, may be reused as drinking water. With reference to FIG. 1B, the water catchment system 130 is located outside the home or bathroom structure, and arranged to collect and store water from rain gutters and/or other piping systems. The water catchment system 130 may deliver the captured water to the storage tank 110 via water treatment system 120. If the storage tank 110 is full, the water may be stored in a separate drum or barrel (not shown) that is in communication with the water catchment system 130. When water is needed from the drum or barrel, it may be delivered from the drum to the storage tank 110 via the electric pump and the water treatment system 120. In other embodiments, other suitable methods that may not require electrical power may be used to deliver water through water treatment system 120 and to the storage tank 110.

The system 100 includes a sink 140 connected to the water storage tank 110, the sink 140 being operable to dispense water from the storage tank 110 to provide clean, running water for handwashing, brushing teeth, and other sanitary or hygienic needs. Preferably, the sink 140 is a low-flow fixture that dispenses water more efficiently as compared to a traditional sink. For example, in some embodiments, the sink 140 may discharge water at a rate of 0.25 gallons per minute, or at a rate of up to 0.5 gallons per minute. A traditional sink typically operates with a flow rate between 1.5 to 2.5 gallons per minute. Preferably, the flow rate is optimized to conserve water while still providing a sufficient flow rate for desired use in the facility. In some embodiments, the sink 140 may further include a sink trap 150 located underneath the sink 140 to trap solids that may damage the seepage pit system 300 (see FIG. 6) if allowed to pass through unhindered. In some embodiments, a discharge valve 160 may be located next to the sink trap 150 for collecting sink water in the event of a frozen discharge system. The collected water may be disposed of manually to avoid potential backflow and/or clogging of the system.

To handle and dispose of waste, the system 100 includes a standalone urinal 170 for handling liquid waste, and also a toilet 180 for handling liquid and solid waste. Preferably, the urinal 170 is a waterless urinal designed to avoid the need to use water in handling liquid waste. In other embodiments, it can be a water-dependent urinal that preferably requires small amounts of water to function. In other embodiments, such as where space may be at a premium, the system 100 may eliminate the urinal 170 and include only the toilet 180 for handling all waste. In some embodiments, the urinal 170 may be piped or otherwise routed to an outdoor infiltration system or seepage pit 300 (see FIG. 6). In other embodiments, the urinal 170 may instead be connected to a container (not shown) via a hose or other piping, where the container can be disposed of manually as needed.

The toilet 180 is preferably designed to separate solid waste and liquid waste for subsequent disposal. To handle odors generated by the solid waste, the system 100 may include a ventilation system 190 that incorporates an energy efficient fan for constantly ventilating the toilet 180 to dry the solid waste and minimize odors within the home. In some embodiments, the ventilation system 190 may include an adjustable damper to allow ventilation of the house or structure to improve indoor air quality while minimizing energy loss. The liquid waste may be piped or otherwise routed to an outdoor infiltration system or seepage pit 300 (see FIG. 6), or to a separate container 214 (see FIG. 2) that can be disposed of manually. With particular reference to FIGS. 2-5, the following section provides additional details of various embodiments and features of the separating toilet 180.

Figure 3:
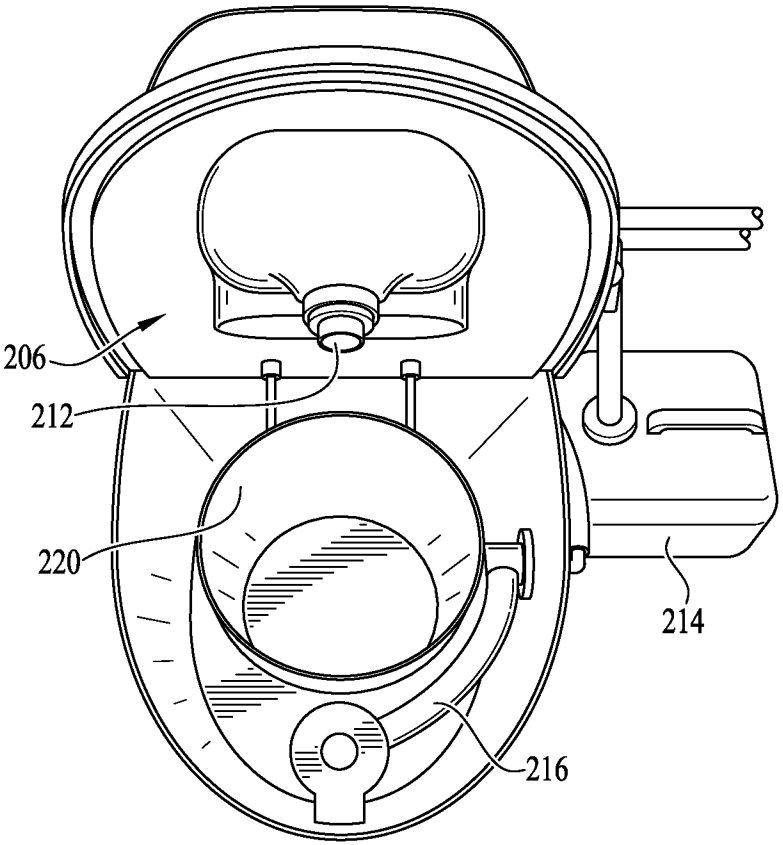
FIGS. 2-3 illustrate details of an example embodiment of a separating toilet that may be used with the portable sanitation system of FIG. 1.
Figure 2:
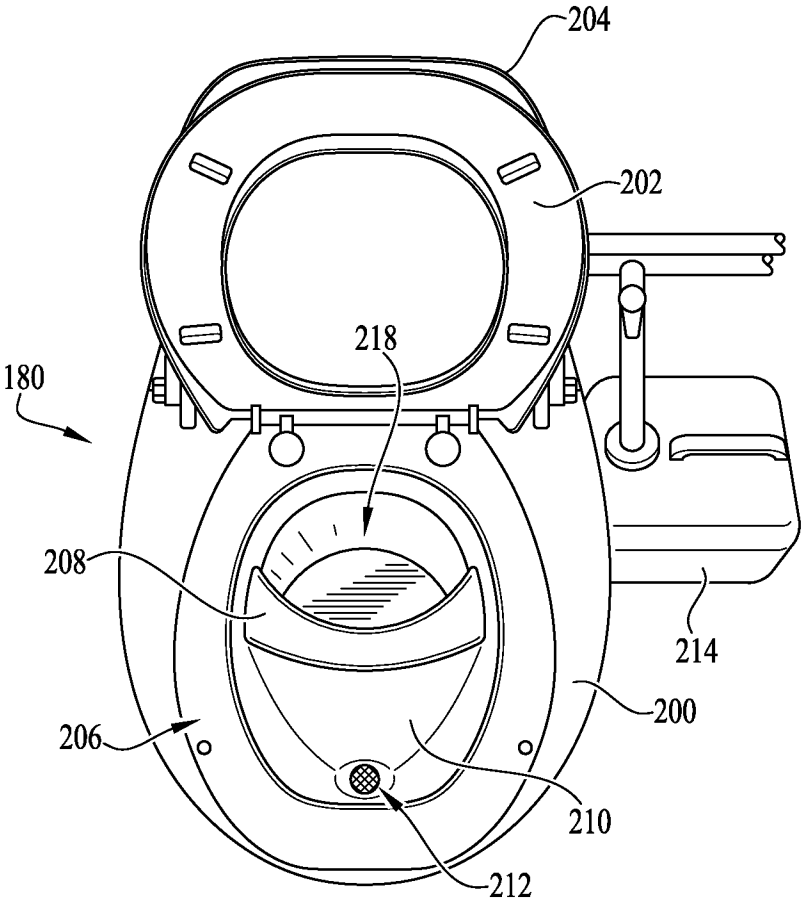

FIGS. 2 and 3 illustrate one example embodiment of a separating toilet 180. With reference to FIG. 2, the separating toilet 180 includes a base 200 supporting a toilet seat 202 and a toilet seat cover 204. The base 200 and seat 202 are designed to support the user during use of the toilet 180. The seat 202 and cover 204 are attached to the base 200 via a hinge (not shown) to support upward and downward movement of the seat 202 and cover 204 as in a conventional toilet. The base 200 further includes a waste intake system 206 designed to separate liquid and solid waste. As illustrated in FIG. 2, the intake system 206 includes a separating wall 208 arranged to compartmentalize the intake system 206, the separating wall 208 diverting liquid waste (e.g., urine) toward the front portion of the intake system 206, and solid waste (e.g., fecal matter) toward the rear portion of the intake system 206.

As illustrated in FIGS. 2 and 3 collectively, the front portion of the intake system 206 includes a trough 210 for collecting liquid waste and a drain 212 for directing liquid waste collected in the trough 210 for disposal. In some embodiments, the drain 212 may be in communication with a separate container 214 via a tube 216 for directing liquid waste from the separating toilet 180 to the container 214 for manual disposal. In such embodiments, gravity causes the liquid waste to funnel through the drain 212 and into the container 214. In other embodiments, the tube 216 may direct liquid waste to an exterior infiltration system for disposal.

At the rear portion of the intake system 206, and behind the separating wall 208, is an opening or channel 218 positioned and designed to accept solid waste. The solid waste is collected in a container 220 positioned underneath the intake system 206. The container 220 is in communication with the ventilation system 190 (see FIG. 1) operable for drying the solid waste and controlling odors as mentioned previously. In other embodiments, the container 220 may incorporate fans, filters, and/or odor eliminating devices (not shown) instead of, or in addition to, the ventilation system 190 for more effective drying of solid waste and odor control. As illustrated in the figures, the container 220 is removable from the toilet 180 such that the solid waste can be disposed of in any suitable fashion.

Figure 5:
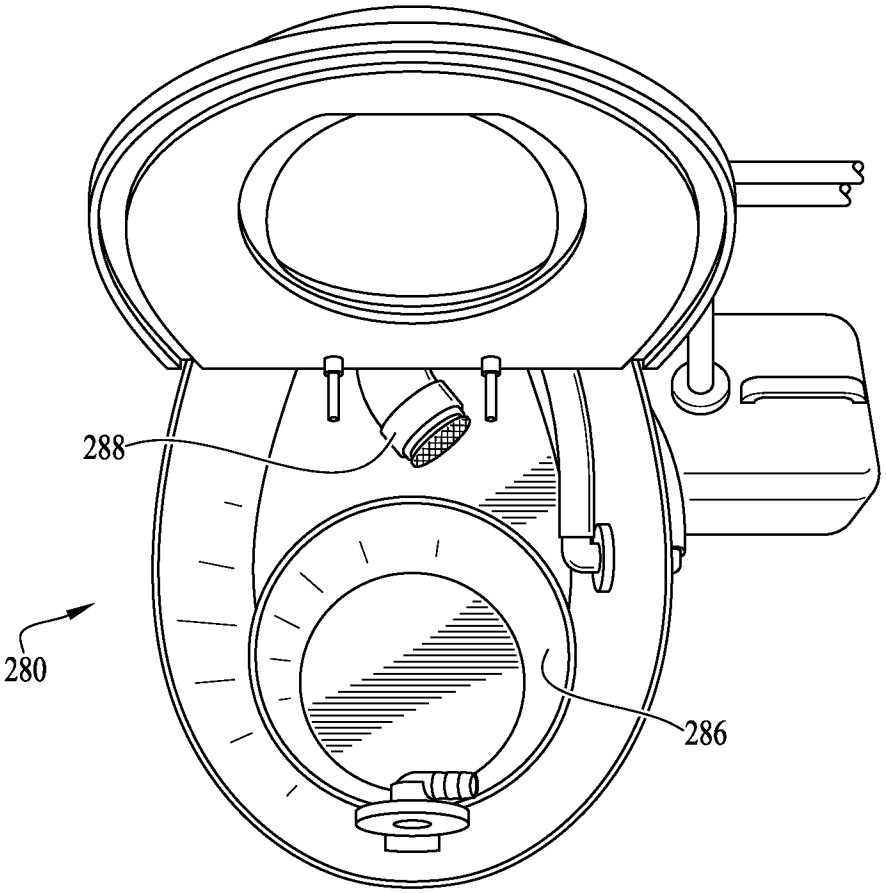
FIGS. 4-5 illustrate details of an example embodiment of another toilet system that may be used with the portable sanitation system of FIG. 1.
Figure 4:
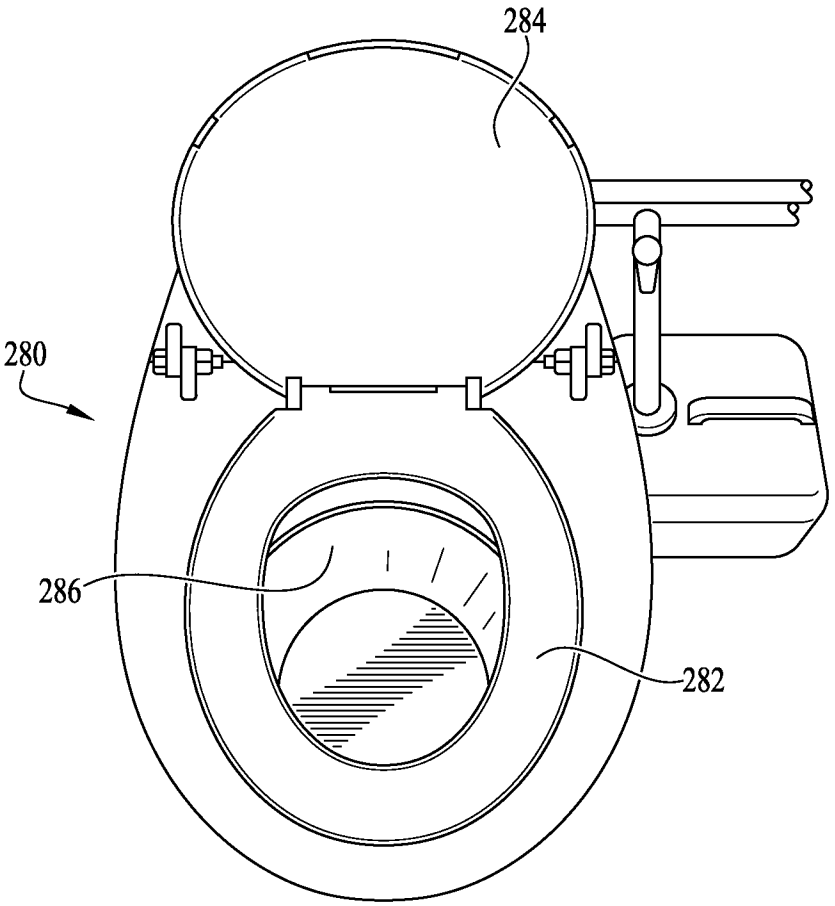

FIGS. 4-5 illustrate another embodiment of a separating toilet 280 that may be used in conjunction with the sanitation system 100. The separating toilet 280 has some of the same features and characteristics as the toilet 180 described previously. Accordingly, certain features of the toilet 280 are not further discussed to avoid obscuring more pertinent features of the embodiment. Briefly, the toilet 280 includes a seat 282 and a seat cover 284 arranged in a similar fashion as described previously with respect to toilet 180. Underneath the seat cover 284, the toilet 280 includes a container 286 for receiving both liquid and solid waste. With reference to FIG. 5, the toilet 280 includes a toilet vent 288 adjacent the container 286. The toilet vent 288 is operable to help dry the solid waste and also to control odor of the waste in the container 286 during use. In some embodiments, the separating toilet 280 may be useful in environments where drainage of the sanitation system 100 freezes or fails due to other factors.

Figure 6:
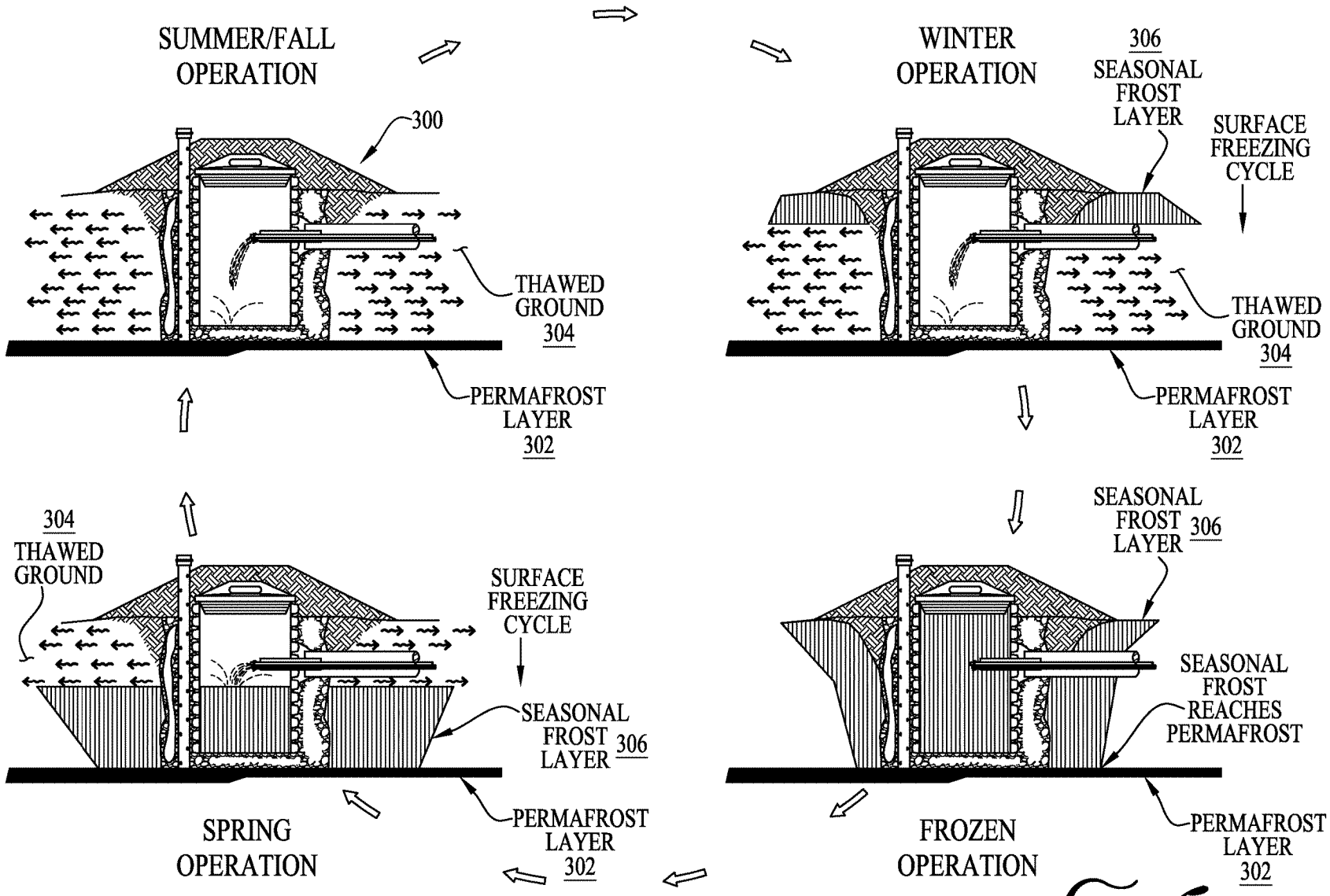
FIG. 6 is a schematic illustration of a seasonal seepage diagram for handling wastewater associated with the portable sanitation system of FIG. 1.

As noted previously, liquid waste from the separating toilets 180, 280 may be disposed of into a seepage pit 300 (if not otherwise disposed of manually). With particular reference to FIG. 6, the following provides additional details illustrating operation of the sanitation system 100 and seepage pit 300 in extreme climates. As illustrated in FIG. 6, the seepage pit 300 is designed specifically for cold climates where the seepage pit 300 may take advantage of typical freezing and thawing cycles of the soil. As illustrated in FIG. 6, during the summer and fall, wastewater (which may include both water and liquid urine waste) can move out of the seepage pit laterally through the thawed soils above the permafrost layer 302. Since the ground 304 is mostly thawed during these seasons, the wastewater essentially moves freely without much issue. As the season transitions to winter, a portion of the surface soil 306 freezes partially or entirely, thereby restricting the release of wastewater from the seepage pit 300 to the thawed soil 304 positioned between the permafrost layer 302 and the seasonal frost layer 306.

As winter continues, the seasonal frost layer 306 continues freezing the soil until the seasonal frost layer 306 reaches the permafrost layer 302. At this point, the soil 304 is fully frozen and drainage via the seepage pit 300 is no longer viable. During the winter therefore, the sanitation system 100 may be switched to a containerized operation, where water from the sink 140 and liquid waste from the urinal 170 and toilet 180 are diverted into one or more containers (not shown) and disposed of manually at a suitable location. In some embodiments, the one or more containers may include a valve or other flow restriction device that allows for the water to be easily diverted into the containers when the seepage pit 300 is not viable for the season. As the season transitions to spring, the seasonal frost layer 306 begins thawing from the surface level down toward the permafrost layer 302. As the soil thaws, wastewater can again move laterally through the seepage pit 300 into the surrounding soil. At that point, the valve or restriction device may be reset to allow water from the sink 140, urinal 170, and toilet 180 to resume flow into the seepage pit 300. Accordingly, the sanitation system 100 can begin to dispose of wastewater through the seepage pit again.

As described, the sanitation system 100 is designed to provide an improved system with most of the functionality of a conventional bathroom with plumbing, while also being designed in a modular configuration with components that can be easily assembled and disassembled to facilitate moving the entire sanitation system 100 (with the exception of seepage pit 300) to a new location to handle erosion issues. In addition, the modular design also helps simplify repairs to specific components as needed.

Figure 7:
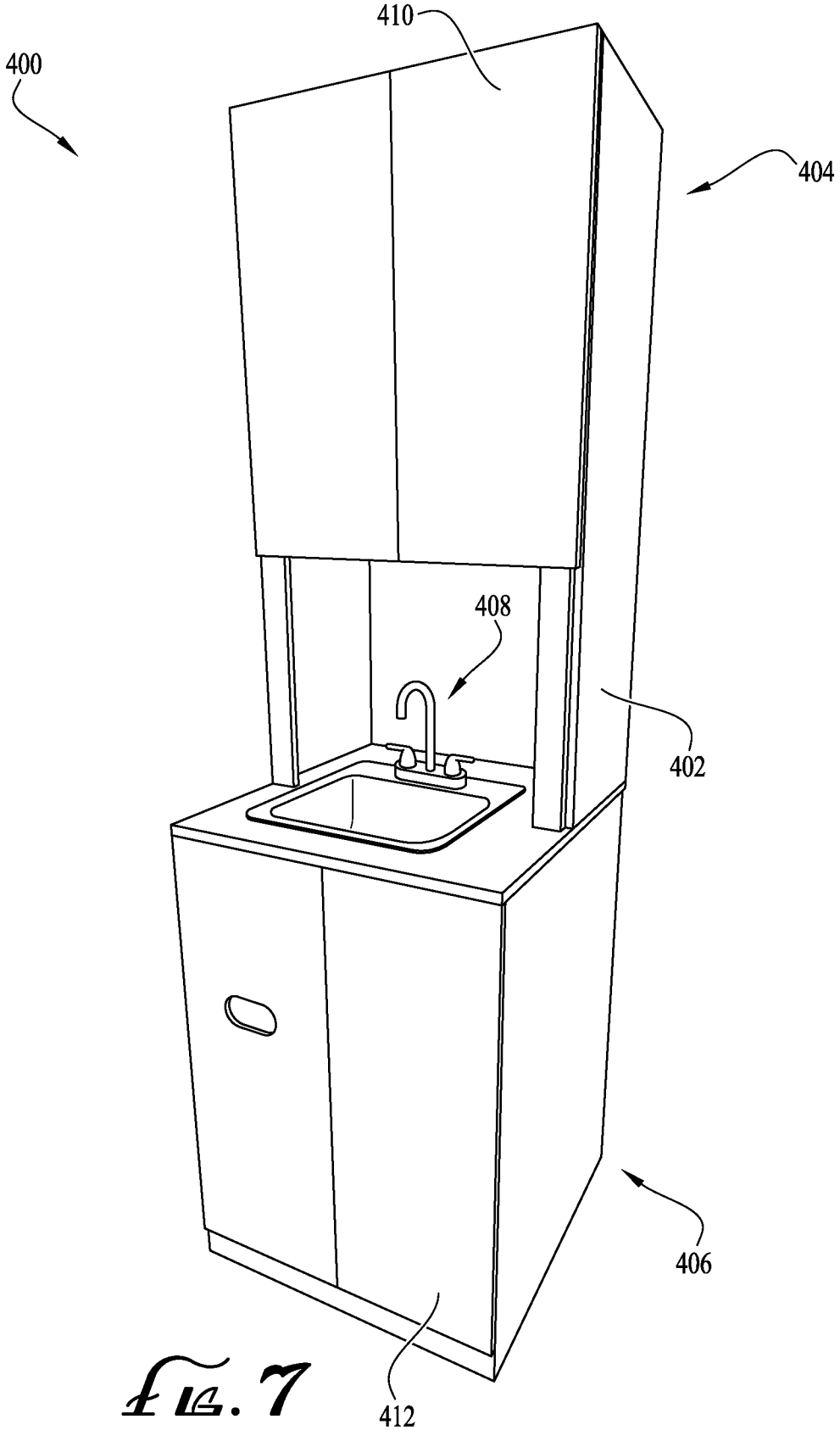
FIGS. 7 and 8 collectively illustrate details of a portable washbasin system in accordance with one embodiment.
Figure 8:
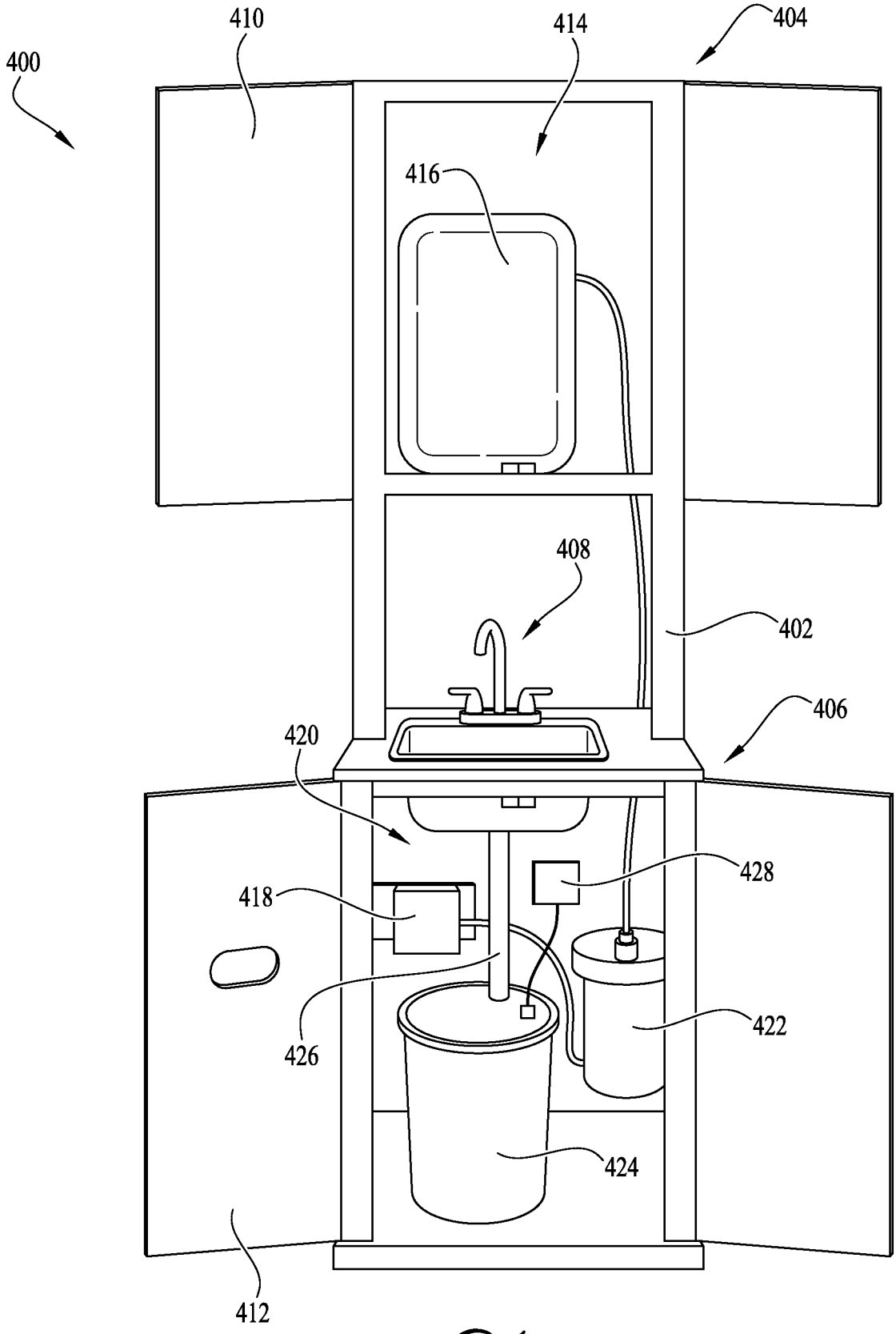

FIGS. 7 and 8 collectively illustrate details of an embodiment for a portable washbasin system 400 in accordance with one embodiment. As noted previously, in some embodiments, the portable washbasin system 400 may be used in conjunction with the sanitation system 100 of FIGS. 1-6. In such embodiments, the portable washbasin system 400 may incorporate some of the same or similar components of the sanitation system 100 packaged in a compact structure to help streamline integration and deployment of the sanitation system 100. In other embodiments, the portable washbasin system 400 may be a standalone system (e.g., without need or use of the components of the sanitation system 100) designed to provide handwashing capabilities for areas lacking running water, plumbing, and/or sewage systems. The following sections begin with a description of the components and features of the portable washbasin system 400 followed by a description of how it may be deployed either as a standalone structure or integrated with the sanitation system 100.

With particular reference to FIGS. 7, the portable washbasin system 400 includes a housing structure 402 having an upper cabinet 404 and a lower cabinet 406 spaced apart from one another along a vertical axis of the housing structure 402. The portable washbasin system 400 further includes a sink 408 supported on the housing structure 402 and positioned between the upper cabinet 404 and the lower cabinet 406. The sink 408 may include any design for dispensing water, such as a faucet lever and spout design, a faucet spout and separate handles, or any other suitable design. As illustrated in FIG. 7, the upper cabinet 404, lower cabinet 406, and sink 408 of the portable washbasin system 400 are all designed such that the housing structure 402 is formed as a single, unitary structure to maximize portability and simplify installation. The upper cabinet 404 and the lower cabinet 406 each include one or more doors 410, 412, respectively. The doors 410, 412 are illustrated in the closed configuration in FIG. 7, but are designed to move to an open configuration to provide access to an interior portion of the respective cabinets 404, 406 and other components of the portable washbasin system 400 housed therein. Each of these components is further described below with reference to FIG. 8.

FIG. 8 illustrates the portable washbasin system 400 in an open configuration, with the doors 410, 412 of the upper cabinet 404 and the lower cabinet 406, respectively, arranged in the open configuration. With reference to FIG. 8, the upper cabinet 404 includes an upper compartment 414 housing a water storage tank 416 therein. The water storage tank 416 is in operable communication with the sink 408, and includes a reservoir designed for storing water that will be dispersed via the sink 408 for supporting handwashing and other hygienic activities. The reservoir and water storage tank 416 may be designed to have any suitable size and dimension, but is preferably sized such that the water storage tank 416 fits within the upper compartment 414 of the upper cabinet 404 when the doors 410 are closed. For example, in some embodiments, the water storage tank 416 may hold at least 20 gallons of clean water ready for use via the sink 408. As illustrated in FIG. 8, the water storage tank 416 is elevated above the sink 408 to provide water to the sink 408 via a gravity flow without the need for a distribution pump or other mechanism, thereby allowing the portable washbasin system 400 to be usable in areas without electricity or other sources of power. In other embodiments, the water storage tank 110 may incorporate an electric pump connected to an electric source for pumping water to the sink 408 as needed.

Water to the water storage tank 416 may be provided in whole or in part via an exterior water container (not shown) outside the house or facility where the portable washbasin system 400 is deployed. In some embodiments, the water from the container may be drawn into the washbasin system 400 via a pump 418 housed within a lower compartment 420 of the lower cabinet 406. The pump 418 may be an electric suction pump or other suitable pump capable of drawing water from the water container as needed. In some embodiments, the exterior water container may be an open container for storing the water. Because the water container is open to the elements, debris and contaminants may be introduced into the water stored therein. Accordingly, the water pumped from the water container may be filtered via a dual gradient filter 422 to remove sediment and any contaminants prior to it being delivered and stored in the water storage tank 416. Filtering the water not only provides cleaner water for use via the sink 408, but it also helps protect the integrity of the water storage tank 416 and any downstream piping and fixtures. The filter 422 may be of any suitable design and specification for removing particle contaminants where the open water container is deployed. For example, in some embodiments, the filter 422 may be a dual stage 25 μm/1 μm nominal poly filter. It should be understood that in other embodiments, other filters and/or filtering methods may be used instead.

In some embodiments, the water in the storage tank 110 may be drawn from a pre-treated water source, or may instead be disinfected and/or purified via any suitable method to ensure that the water is safe for use. For example, in some embodiments, the portable washbasin 400 may include a water treatment system (not shown in FIGS. 7-8, but similar to water treatment system 120 of FIGS. 1-6) that may be in communication with the water storage tank 110 to provide filtration and disinfection that complies with federal and state drinking water treatment requirements, thereby providing potable water that is safe for human consumption. In such embodiments, the water treatment system may include any of various suitable filtration devices operable to filter water, such as efficient cartridge filters and other similar devices. In other embodiments, the filter 422 may be selected with specifications to ensure the water delivered to the water storage tank 110 is safe for human consumption.

With reference to FIG. 8, the portable washbasin system 400 may include one or more water receptacles 424, such as a five-gallon bucket, a barrel, or any other suitable container, the water receptacle 424 positioned in the lower compartment 420 of the lower cabinet 406 for collecting and temporarily storing wastewater from the sink 408. The receptacle 424 includes a closed bottom surface, an open top surface opposite the bottom surface, and an interior chamber defined therebetween for collecting and storing the wastewater. The receptacle 424 is positioned underneath a drain pipe 426 or other suitable conduit of the sink 408. In this configuration, wastewater funnels from the sink 408 into the drain pipe 426 via a gravity flow and is collected in the receptacle 424. Preferably, the receptacle 424 is freestanding within the lower compartment 420 of the housing structure 402 and is not fastened, affixed, or otherwise coupled to any portion of the housing structure 402 such that it is easily removable from the housing structure 402 as needed without the use of tools. In such embodiments, once the receptacle 424 has been filled to a predetermined amount, it can be manually removed from the lower compartment 420 and its contents disposed of in a seepage pit, disposal area, or in any other suitable fashion. In some embodiments, the drain pipe 426 may include an in-line 30 μm strainer (not shown) to capture solid materials and prevent them from reaching the receptacle 424.

In some embodiments, the receptacle 424 may include a water overflow sensor 428 designed to monitor the water level in the receptacle 424. In some embodiments, the overflow sensor 428 is positioned at a predetermined height relative to the receptacle 424 to ensure that water does not exceed the predetermined height and flow out of the receptacle 424. When the overflow sensor 428 detects that the water level in the receptacle 424 has reached the predetermined threshold value, such as when the receptacle 424 is 75% full, the overflow sensor 428 may generate an alarm to alert the user that the receptacle 424 should be emptied before it overflows. Depending on the specification of the overflow sensor 428, the alarm may take any one of various suitable forms. For example, in some embodiments, the sensor 428 may generate an audible alarm alerting the user of the water level and the need for the receptacle 424 to be emptied. In other embodiments, the sensor 428 may be wirelessly connected to a mobile phone or other electronic device and send a text message or email to the user. Once the user hears the audible alarm or receives the message, the user may then open the lower cabinet 406 and manually remove the receptacle 424 for disposal of the collected wastewater.

In some embodiments, the portable washbasin system 400 may be a standalone structure as described previously, with the portable washbasin system 400 being connected to an outdoor water source to provide clean water for handwashing and other hygiene activities. In other embodiments, the portable washbasin system 400 may instead be connected to an outdoor seepage pit system (similar to seepage pit system 300 of FIG. 6). In such embodiments, the water receptacle 424 may be removed and the drain pipe 426 may be routed to the exterior of the home or building where the portable washbasin system 400 is deployed and into the seepage pit system for disposal of any wastewater.

In other embodiments, the portable washbasin system 400 may include both the receptacle 424 for manual disposal and a connection to an exterior seepage pit system for disposal of wastewater. Such embodiments may be advantageous in environmental conditions where the ground adjacent the seepage pit system undergoes freeze and thaw cycles during seasonal changes. For example, as described previously with reference to FIG. 6, during summer and fall months in some regions, wastewater may be directed to the seepage pit system since the water can move rather freely through the thawed soils above the permafrost layer. However, once the ground fully freezes during the winter and colder months, distribution of the water to the seepage pit is hindered. During these seasons, the wastewater may instead be captured in the receptacle 424 within the portable washbasin system 400 for manual disposal.

In such embodiments, the portable washbasin system 400 may include a drain pipe (similar to drain pipe 426) with a first outlet arranged to direct wastewater to the receptacle 424 (in a similar fashion as described with reference to FIG. 8), and a second outlet connected to the seepage pit system to direct wastewater to the seepage pit system when seasonal conditions are favorable for receiving water in the seepage pit. In some embodiments, the drain pipe may include one or more valves (or other suitable flow diversion devices) operable to close off one of the first or second outlets to ensure that any wastewater is properly directed either to the receptacle 424 or the seepage pit system as desired.

In still other embodiments, the portable washbasin system 400 may be incorporated as part of the sanitation system 100 of FIGS. 1-6, albeit with some modifications to streamline the overall design and avoid duplication of components. For example, the water storage tank 110 of FIG. 1A may be stored within the upper compartment 414 of the portable washbasin system 400 as described with reference to FIGS. 7-8. In the integrated system, water to the portable washbasin system 400 may be delivered from the open water container via the pump 418 as described previously. In other embodiments, water may also be delivered via the water catchment system 130 (see FIG. 1B) located outside the overall room or enclosure housing the components of the sanitation system 100. Moreover, the standalone sink 140 of the sanitation system 100 is no longer necessary as the portable washbasin system 400 includes the sink 408. The remaining components of the sanitation system 100 including the urinal 170, the separating toilet 180, and the ventilation system 190 may be configured and incorporated in a similar fashion as described previously. In such embodiments, the portable washbasin system 400 may be connected to the seepage pit system 300 or may include the receptacle 424 for collection and manual disposal of wastewater, or may include both configurations as described previously.

It should be understood that many of the features, components, and processes described in the embodiments of FIGS. 1-8 are for illustration purposes. Accordingly, one having ordinary skill in the art may rearrange the features and process steps described herein in any of the embodiments without departing from the principles of the disclosure. In addition, it is intended that subject matter disclosed in portion herein can be combined with the subject matter of one or more of other portions herein as long as such combinations are not mutually exclusive or inoperable. In addition, many variations, enhancements, and modifications of the concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. A portable washbasin system comprising:

a housing structure including an upper compartment and a lower compartment spaced apart from one another, wherein the upper compartment further includes a base on an interior portion thereof and one or more doors moveable between a closed configuration, whereat the one or more doors enclose the interior portion of the upper compartment, and an open configuration, whereat the one or more doors provide access to the interior portion of the upper compartment;

a water storage tank including a reservoir for storing water, the water storage tank supported on the base of the interior portion of the upper compartment of the housing structure, the water storage tank being removable from the upper compartment of the housing structure;

a sink including a water dispenser supported on the housing structure, wherein the water dispenser is positioned between the upper compartment and the lower compartment, the water storage tank offset from and elevated relative to the water dispenser, and wherein the water dispenser is in operable communication with the water storage tank, the water dispenser receiving water from the water storage tank and dispensing the received water into the sink;

a water receptacle housed in the lower compartment of the housing structure, the water receptacle including a closed bottom surface and an open top surface opposite the bottom surface, the water receptacle having an interior chamber between the closed bottom surface and the open top surface for collecting water from the sink;

a pump housed within the lower compartment of the housing structure, wherein the pump is in operable communication with the water storage tank, the pump drawing water from an exterior water storage container outside the housing structure and into the water storage tank; and a conduit in operable communication with the sink and the water receptacle, wherein water dispersed from the sink passes through the conduit and into the water receptacle via the open top surface thereof, the water collected in the water receptacle for subsequent disposal.

2. The portable washbasin system of claim 1, further comprising an overflow sensor in operable communication with the water receptacle, the overflow sensor operable to detect a level of the collected water in the water receptacle and generate an alarm when the level exceeds a predetermined threshold level.

3. The portable washbasin system of claim 1, further comprising a filter in operable communication with the pump and the water storage tank, wherein water drawn via the pump passes through the filter for filtration before being stored in the water storage tank.

4. The portable washbasin system of claim 1, wherein the conduit is further in operable communication with a seepage pit, the conduit operable to direct water from the sink to the seepage pit.

5. The portable washbasin system of claim 1, wherein water from the water storage tank is delivered to the sink via a gravity flow and without the aid of electrical power.

6. The portable washbasin system of claim 1, further comprising a filter in operable communication with the water storage tank, the filter operable to purify water in the water storage tank to ensure the water is free of particle contaminants.

7. The portable washbasin system of claim 1, further comprising a water catchment system operable for collecting and directing water to the exterior water storage container.

8. The portable washbasin system of claim 1, wherein the water receptacle is freestanding within the lower compartment of the housing structure, the water receptacle being manually removable therefrom for disposal of the collected water.

9. The portable washbasin system of claim 1, further including a strainer within the conduit, the strainer operable for collecting solid waste materials passing through the sink to divert solid waste materials from the water receptacle.

10. The portable washbasin system of claim 1, wherein the portable housing structure further includes a second door system different from the first door system of the portable housing structure, the second door system in communication with the lower compartment, the second door system including one or more doors movable between a closed configuration whereat the one or more doors enclose the lower compartment, and an open configuration whereat the one or more doors provide access to the water receptacle housed in the lower compartment.

11. The portable washbasin system of claim 10, wherein the housing structure is formed as a single, integrated structure.

12. The portable washbasin system of claim 1, wherein the sink is in communication with a seepage pit, wherein water dispersed from the sink is diverted into the seepage pit.

13. The portable washbasin system of claim 12, wherein the conduit includes one or more flow diversion devices in communication therewith, the one or more flow diversion devices selectively operable to divert water from the sink either to the water receptacle within the lower compartment or to the seepage pit.

14. The portable washbasin system of claim 1, further comprising an overflow sensor positioned at a predetermined height relative to the water receptacle, the overflow sensor operable to detect a level of the collected water in the water receptacle at the predetermined height and generate a signal indicating that the level of the collected water has exceeded a predetermined threshold level.

15. The portable washbasin system of claim 14, wherein the overflow sensor is further in communication with an electronic device, and the signal includes instructions to the electronic device to generate an audible alarm.

16. A portable washbasin system comprising:

a housing structure including an upper compartment and a lower compartment spaced apart from one another;

a water storage tank including a reservoir for storing water, the water storage tank housed in the upper compartment of the housing structure;

a sink supported on the housing structure and positioned between the upper compartment and the lower compartment, the sink in operable communication with the water storage tank, the sink receiving water from the water storage tank and dispensing the received water;

a water receptacle housed in the lower compartment of the housing structure, the water receptacle including a closed bottom surface and an open top surface opposite the bottom surface, the water receptacle having an interior chamber between the closed bottom surface and the open top surface for collecting water from the sink; and a conduit in operable communication with the sink and the water receptacle, wherein water dispersed from the sink passes through the conduit and into the water receptacle via the open top surface thereof, the water collected in the water receptacle for subsequent disposal, wherein the conduit includes a first outlet arranged to direct water from the sink to the water receptacle, and a second outlet in communication with a seepage pit to direct water from the sink to the seepage pit, the conduit further including one or more flow diversion devices operable to selectively close off the first outlet to direct water from the sink to the seepage pit and the second outlet to direct water from the sink to the water receptacle.

17. The portable washbasin system of claim 16, further comprising a pump in operable communication with the water storage tank, the pump drawing water from an exterior water storage container outside the housing structure and into the water storage tank.

18. The portable washbasin system of claim 16, further comprising an overflow sensor in operable communication with the water receptacle, the overflow sensor operable to detect a level of the collected water in the water receptacle and generate an alarm when the level exceeds a predetermined threshold level.

19. The portable washbasin system of claim 16, further including a strainer within the conduit, the strainer operable for collecting solid waste materials passing through the sink to divert solid waste materials from the water receptacle.

20. The portable washbasin system of claim 16, further comprising a filter in operable communication with the water storage tank, wherein water passes through the filter for filtration before being stored in the water storage tank.

* * * * *